US008772679B2

(12) United States Patent
Novikov

(10) Patent No.: US 8,772,679 B2
(45) Date of Patent: Jul. 8, 2014

(54) METHOD AND SYSTEM FOR CONTROLLING A HEATING ELEMENT WITH TEMPERATURE SENSITIVE CONDUCTIVE LAYER

(75) Inventor: Lenny Novikov, Cliffside Park, NJ (US)

(73) Assignee: Weiss Controls, Inc., Holtsville, NY (US)

( * ) Notice: Subject to any disclaimer, the term of this patent is extended or adjusted under 35 U.S.C. 154(b) by 1082 days.

(21) Appl. No.: 12/727,544

(22) Filed: Mar. 19, 2010

(65) Prior Publication Data

US 2010/0237060 A1 Sep. 23, 2010

Related U.S. Application Data

(60) Provisional application No. 61/210,499, filed on Mar. 19, 2009.

(51) Int. Cl.
*H05B 3/34* (2006.01)

(52) U.S. Cl.
USPC ..... 219/488; 219/528; 219/529

(58) Field of Classification Search
USPC ..... 219/528, 212, 549, 529, 217, 494, 527, 219/211, 488, 490
See application file for complete search history.

(56) References Cited

U.S. PATENT DOCUMENTS

| | | | | |
|---|---|---|---|---|
| 4,692,597 | A | 9/1987 | Tsuda et al. | |
| 5,464,964 | A | 11/1995 | Okuda et al. | |
| 5,611,952 | A | 3/1997 | Jones | |
| 5,861,610 | A | 1/1999 | Weiss | |
| 6,222,162 | B1 | 4/2001 | Keane | |
| 6,310,332 | B1 | 10/2001 | Gerrard | |
| 7,180,037 | B2 | 2/2007 | Weiss | |
| 2003/0178412 | A1 | 9/2003 | Goldberg et al. | |
| 2005/0263518 | A1 * | 12/2005 | Weiss | 219/482 |

FOREIGN PATENT DOCUMENTS

JP 58213314 A 12/1983

OTHER PUBLICATIONS

International Search Report mailed Oct. 8, 2010 issued by the International Searching Authority in related International Application No. PCT/US2010/027988 (3 pages).
Written Opinion mailed Oct. 8, 2010 issued by the International Searching Authority in related International Application No. PCT/US2010/027988 (3 pages).

* cited by examiner

*Primary Examiner* — John Wasaff
(74) *Attorney, Agent, or Firm* — Robert P. Michal; Lucas & Mercanti LLP

(57) ABSTRACT

Methods and system for controlling a heater conductor in a heating element including a sensor conductor separated from the heater conductor by an NTC layer. The heating element is coupled to a control circuit and the flow of electricity from a direct current source through the circuit is controlled such that a change of the resistance of the NTC layer is indicative of the temperature of the heater conductor. This resistance is detected based on a time or amplitude analysis and based thereon, a heating mode of the heater conductor is controlled. In a variation, the circuit is operated in a two-period measurement mode wherein the energy transferred through the NTC layer in one period is equal and opposite to the energy transferred through the NTC layer in the other period.

5 Claims, 8 Drawing Sheets

METHOD AND SYSTEM FOR CONTROLLING A HEATING ELEMENT WITH TEMPERATURE SENSITIVE CONDUCTIVE LAYER

CROSS-REFERENCE TO RELATED APPLICATION

This application claims priority under 35 USC 119 of U.S. Provisional Patent Application Ser. No. 61/210,499 filed Mar. 19, 2009, the entire disclosure of which is incorporated by reference herein.

FIELD OF THE INVENTION

The present invention relates generally to a method and system for controlling a heater conductor (for example a wire) of a heating element including a negative temperature coefficient (NTC) layer and more specifically to a method and system for controlling a flexible heater conductor having a conductive core with an NTC layer and a helically wound sensor conductor within an insulative outer sheath.

BACKGROUND INFORMATION

Modern heating pads and electronic blankets have heater wires (conductors) that do not require separate thermostats. They fall into two basic types: a heater wire having a positive temperature coefficient (PTC) heating layer arranged between two conductors that exhibits an increased resistance with an increase in temperature so that the wire is self-limiting and not subject to hot spots; and a heater wire that provides a feedback signal to a control for monitoring temperature and detecting local hot spots.

A prior art system that uses a feedback signal for temperature control concurrently with a voltage, that also indicates the occurrence of a hot spot that deteriorates the insulation between a heater conductor and a sensor or sensor wire, is described in U.S. Pat. No. 5,861,610. A PTC nickel alloy sensor wire is counter-wound around a heater wire with an inner insulation therebetween. Current leakage through the insulation electrically couples the sensor wire and the heater wire. Resistance of the sensor wire is measured and used for temperature control. An alternating current (AC) voltage present on the sensor wire indicates the existence of a breakdown in the separating insulation. When polyvinylchloride (PVC) is used as the separating layer, small leakage occurs at about 160° C. When polyethylene is used as the separating layer, the layer melts at about 130° C. and contact is made between the heater wire and the sensor wire. In both cases, i.e., when leakage occurs or contact between the heater wire and the sensor wire is made, the control unit disconnects power to the heater wire.

A similar technique is disclosed in U.S. Pat. No. 6,310,332 (Gerrard), the entire disclosure of which is incorporated herein by reference, wherein a second conductor is used as a heater with the insulation having an enhanced Negative Temperature Coefficient (NTC) characteristic. The two heating conductors are connected through a diode so that leakage through the NTC layer introduces the negative half cycle, which presence causes termination of the power. In a second embodiment, the second conductor is a PTC sensor wire, such as disclosed in U.S. Pat. No. 5,861,610, the entire disclosure of which is incorporated herein by reference.

A smaller more flexible heater wire design is disclosed in U.S. Pat. No. 6,222,162 (Keane), the entire disclosure of which is incorporated herein by reference, and uses a single conductor of a PTC alloy for both heating and temperature sensing. In this device, only the average temperature is used to control the temperature of the wire.

To address these concerns, a heater wire is disclosed in U.S. Pat. No. 7,180,037 (Weiss), the entire disclosure of which is incorporated herein by reference, which is operated with an alternating current power supply. The heater wire has a conductive core with an NTC layer and a helically wound sensor conductor within an insulative outer sheath. The conductive core is coupled to a control circuit, with a phase shift relative to the AC power supply being indicative of the temperature of the wire.

OBJECTS AND SUMMARY OF THE INVENTION

An object of the present invention is to provide a method and system for controlling a direct current-operated heating element comprising a heating conductor and a sensor conductor separated by an NTC layer that decreases its resistance with increasing temperature. The parallel arrangement of the NTC layer enhances the detection of local hot spots anywhere along the surface of the heating element.

The heater wire described in U.S. Pat. No. 7,180,037 (Weiss), incorporated in its entirety by reference herein, where the heater wire is operated with an alternating current power supply, may be used as an example of a heating element for present invention. A direct DC application of this type of heating element is unreliable because the NTC conductive layer is subject to polarization and aging under DC conditions, therefore it is imperative to measure resistance of the NTC layer without polarizing any portion of it.

While the following description of the methods and systems refers to the construction of that particular heating element, comprising a heater wire, a sense or sensor wire, and an NTC layer between them, it is understood that the proposed technology is valid for any types of heating elements employing the NTC layer as a temperature sensing component, whether constructed with wires or any other conductor types.

It is yet another object of the present invention to provide a method and system to measure resistance of the NTC layer without polarizing it.

In the proposed solution, the heating element is coupled to a control circuit and the flow of electricity from a direct current (DC) source through the circuit is controlled such that a change of the resistance of the NTC layer is indicative of the temperature of the heater wire. This resistance is detected based on a time or amplitude analysis and based thereon, a heating mode of the heating element is controlled. For example, when the heating element is above a threshold temperature, the heating mode is not initiated.

The methods and systems described herein operate the heating element by periodically interrupting the heating mode, when the heating element is powered from a DC source, with the measurement mode, when the NTC layer resistance is measured. Based on this evaluation the following heating mode cycle is skipped and/or replaced with a non-heating interval to achieve temperature regulation of the heating element.

In a variation of the method and system, the measurement cycle is performed with only alternating current (AC) passing through the NTC layer while the NTC layer resistance is measured based on a time or amplitude analysis and based thereon, a heating mode of the heater wire is controlled.

In another variation of the method and system, the circuit is operated in a two-period measurement mode wherein the energy transferred through the NTC layer in one period is equal and opposite to the energy transferred through the NTC layer in the other period. In the first period of the measurement mode, DC current from a DC source is directed through the NTC layer in a first direction and based thereon, a heating mode of the heater wire is controlled. In the second period of the measurement mode, which may immediately follow the first period, the DC power current from the DC source is directed through the NTC layer in a second direction, opposite to the first one, and the time of flow of the DC power current in the second direction is controlled to provide an equal energy transfer through the NTC layer during the two periods of the measurement mode. The time may be controlled based on a time in which DC current flowed through the NTC layer in the first measurement period, and amplitudes of the current through the NTC layer in the first and second measurement periods such that a product of the amplitude and time for the first measurement period equals the product of the amplitude and time for the second measurement period. This equal energy transfer technique may be implemented using a capacitor that is charged in the first period and discharged in the second period, or controlled to ensure that the current through the NTC layer in the second period is of the same magnitude as the current through the NTC layer in the first period but opposite in direction, e.g., via switches.

Control of the heater wire is particularly suitable for use with DC (Direct Current) operated appliances such as heating pads and electric blankets.

BRIEF DESCRIPTION OF THE DRAWINGS

The invention may best be understood by reference to the following detailed description of illustrative embodiments when read in conjunction with the accompanying drawings, wherein.

DETAILED DESCRIPTION

The description of the preferred embodiments given below is intended for illustration and not for limitation purposes, and it is understood that those skilled in art can find different implementations of this invention without departing from the scope and spirit of the invention. It is further understood that the illustrative drawings and corresponding descriptions use labels such as "SENSE WIRE" and "HEATER WIRE" for illustration purposes only, and Rntc represents a distributed resistance property of the NTC layer. To simplify the discussion, it is assumed that the NTC layer resistance is significantly higher than the resistance of the heater wire or sense wire, and the effect of the actual heater or sense wires resistance on the results of the NTC layer resistance measurements is diminishingly small and may be neglected.

Figure 1A:
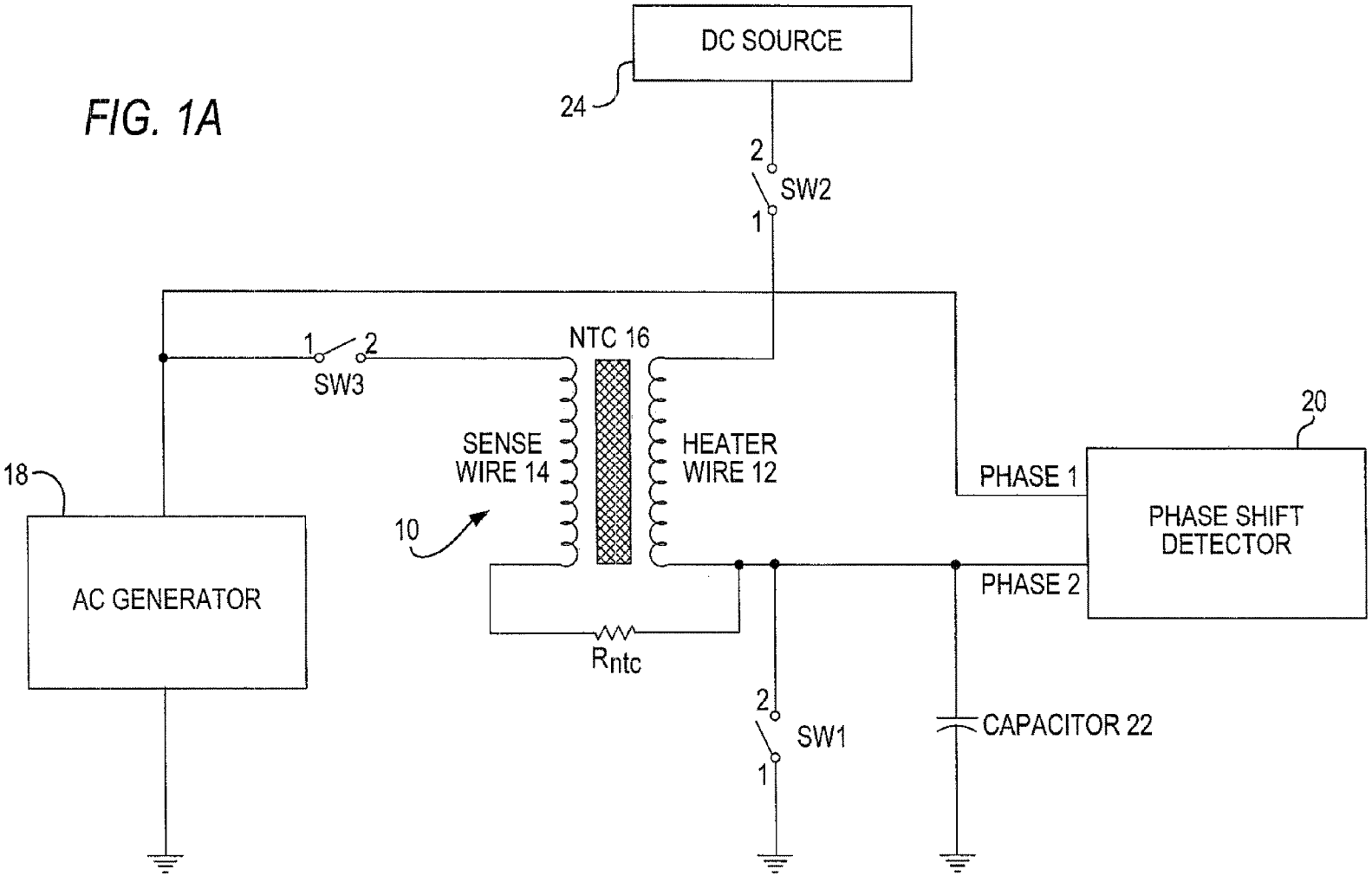
FIG. 1A is a schematic of a first embodiment of a system for controlling a heater wire of a heating element using an AC excitation technique.

Referring to the accompanying drawings wherein like reference numbers refer to the same or similar elements, FIG. 1A illustrates a first embodiment of the invention wherein an alternating current (AC) excitation method uses direct current (DC) to power a heater wire and an AC generator to measure the resistance of a negative temperature coefficient (NTC) layer.

In this embodiment, a system for controlling a heater wire in accordance with the invention includes a heating element 10 that comprises the heater wire 12, a sensor wire 14, and an NTC conducting layer 16 interposed between the heater wire 12 and the sensor wire 14 to separate them from one another. Resistor Rntc is not a component of the heating element 10 per se but rather represents a distributed resistance property of the NTC layer 16.

The heating element 10 is placed in a circuit with a DC Source 24, an AC generator 18, or other source of alternating current, and a phase shift detector 20, along with switches SW1, SW2, SW3 and a capacitor 22 as shown in FIG. 1A. Instead of switches, it is foreseen that other electronic components as known in the art that enable selective control of the flow of electricity may be used.

The circuit has two operating modes. In a first, heating mode, switches SW1 and SW2, connected to the first and second ends of the heater wire 12, respectively, are closed, and switch SW3, interposed between the sensor wire 14 and the AC generator 18, is open. A DC power current from the DC source 24 (e.g., a battery) flows through the heater wire 12 increasing its temperature. The sensor wire is floating and polarization of the NTC layer 16 does not occur. Every few seconds, the heating mode is interrupted, e.g., by opening the switches SW1 and SW2, and the circuit is switched into a second, measurement or sensing mode.

During the measurement mode, switches SW1 and SW2 are open, and switch SW3 is closed. The AC generator 18, or another low power AC source, provides an excitation signal to measure the resistance of the NTC layer 16, designated $R_{ntc}$. The resistance $R_{ntc}$ of the NTC layer 16 coupled with the capacitor 22 provides a phase shift proportional to the value of $R_{ntc}$. With an increase in temperature, the resistance $R_{ntc}$ of the NTC layer 16 and the resulting phase shift decrease. The phase shift detector 20 compares the phase shift between PHASE 1 (direct output from the AC generator 18) and PHASE 2 (the AC signal on the capacitor 22) with a preset value. When the detected phase shift is smaller than the preset value, the next heating cycle is skipped to prevent overheating. More generally, the phase shift detector 20 compares a phase shift between an output signal direct from the AC generator 18 and an AC signal on the capacitor 22 relative to the pre-set value, whereby initiation of the heating mode is controlled based on the comparison of the phase shift relative to the pre-set value.

Since only AC current is passing through the NTC layer 16 in this mode, polarization of the NTC layer 16 does not occur.

The capacitor 22 may be substituted with an inductor or any other reactance. If an inductive component is used, the phase shift will occur in a direction opposite to that of the capacitive one, but the magnitude of the shift will still be proportional to the resistance of the NTC layer and indicative of the temperature of the heating element.

Figure 1B:
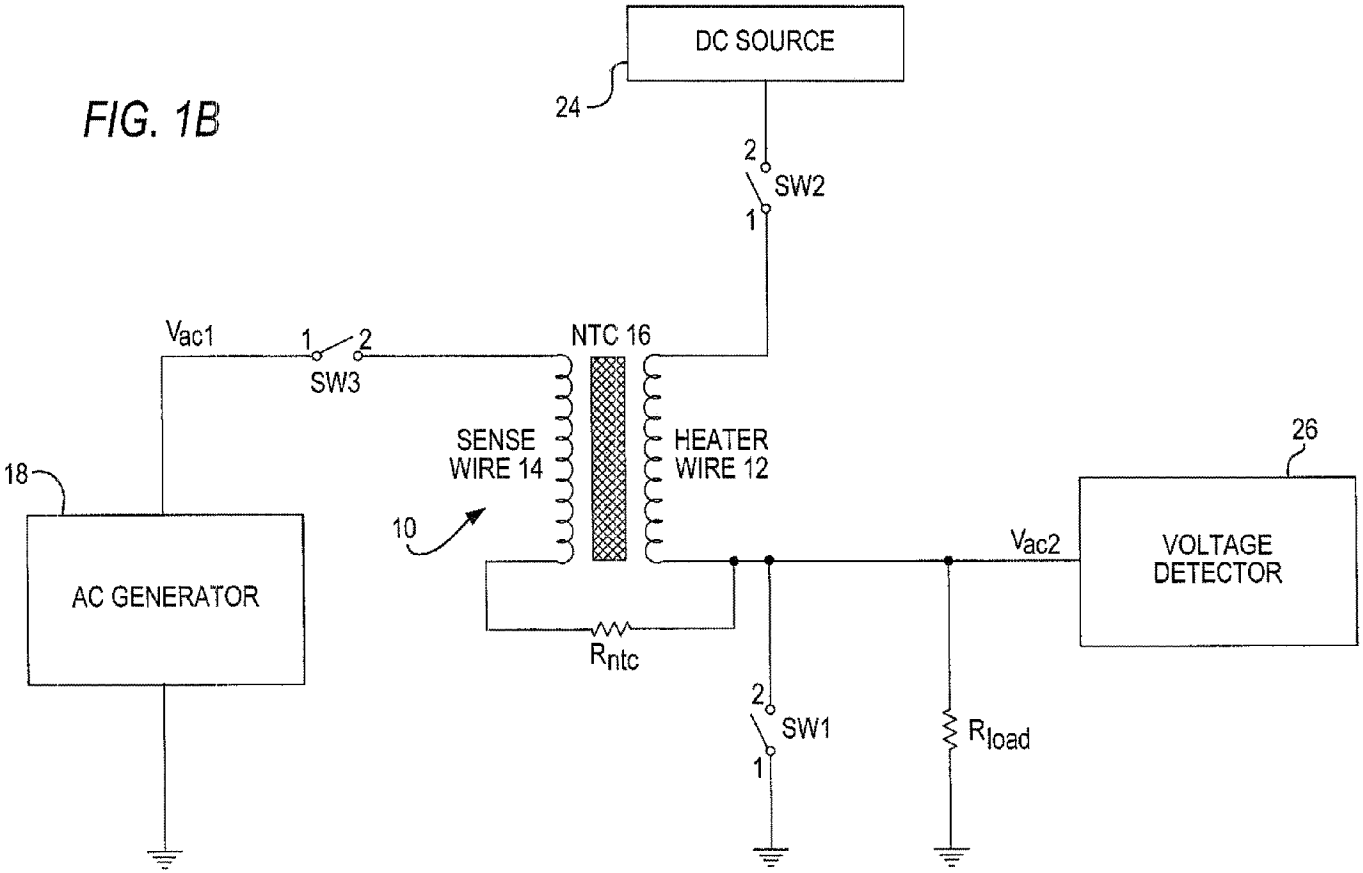
FIG. 1B is a schematic of a second embodiment of a system for controlling a heater wire of a heating element using an AC excitation technique.

FIG. 1B illustrates an amplitude-based implementation of the AC excitation method, similar to that shown in FIG. 1A and the same reference numbers designate the same elements.

However, instead of the phase shift detector 20 and capacitor 22, the circuit shown in FIG. 1B includes a voltage detector 26 and a load resistor $R_{load}$ electrically coupled thereto.

The circuit shown in FIG. 1B also has two operating modes. In a first, heating mode, switches SW1 and SW2 are closed, and switch SW3 is open. A DC power current from the DC source 24 (e.g., a battery) flows through the heater wire 12 increasing its temperature. The sensor wire 14 is floating and polarization of the NTC layer 16 does not occur. Every few seconds, this mode is interrupted, e.g., by opening the switches SW1 and SW2, and the circuit is switched into a second, measurement or sensing mode.

During the measurement mode, switches SW1 and SW2 are open, and switch SW3 is closed. AC generator 18, or another low power AC source, provides an excitation signal to measure the resistance $R_{ntc}$ of the NTC layer 16. The resistance $R_{ntc}$ of the NTC layer 16 coupled with the load resistor $R_{load}$ forms a voltage divider. The output voltage of this voltage divider is:

$$V_{ac2}=V_{ac1}*R_{load}/(R_{ntc}+R_{load})$$

wherein $V_{ac1}$ is the known voltage at the output of AC generator 18, and $V_{ac2}$ is the voltage of the voltage divider.

To derive the value of $R_{ntc}$, this equation is transformed to:

$$R_{ntc}=(V_{ac1}/V_{ac2}-1)*R_{load}$$

With an increase in temperature, the resistance $R_{ntc}$ of the NTC layer 16 decreases, and the output voltage of the voltage divider increases. A voltage detector 26 compares the output voltage $V_{ac2}$ of the voltage divider with a preset value, and when the output voltage $V_{ac2}$ is greater than the pre-set value, the next heating cycle is skipped. More generally, the voltage detector 26 compares an output voltage of the voltage divider with the pre-set value, with initiation of the heating mode being controlled based on the comparison of the output voltage of the voltage divider to the pre-set value.

If the output voltage of the AC generator 20 is subject to change, the ratio of voltages $V_{ac1}$ and $V_{ac2}$ provides a reliable measure of the temperature of the NTC layer 16.

Since only AC current is provided through the NTC layer 16 in this mode, polarization of the NTC layer 16 does not occur.

Figure 2A:
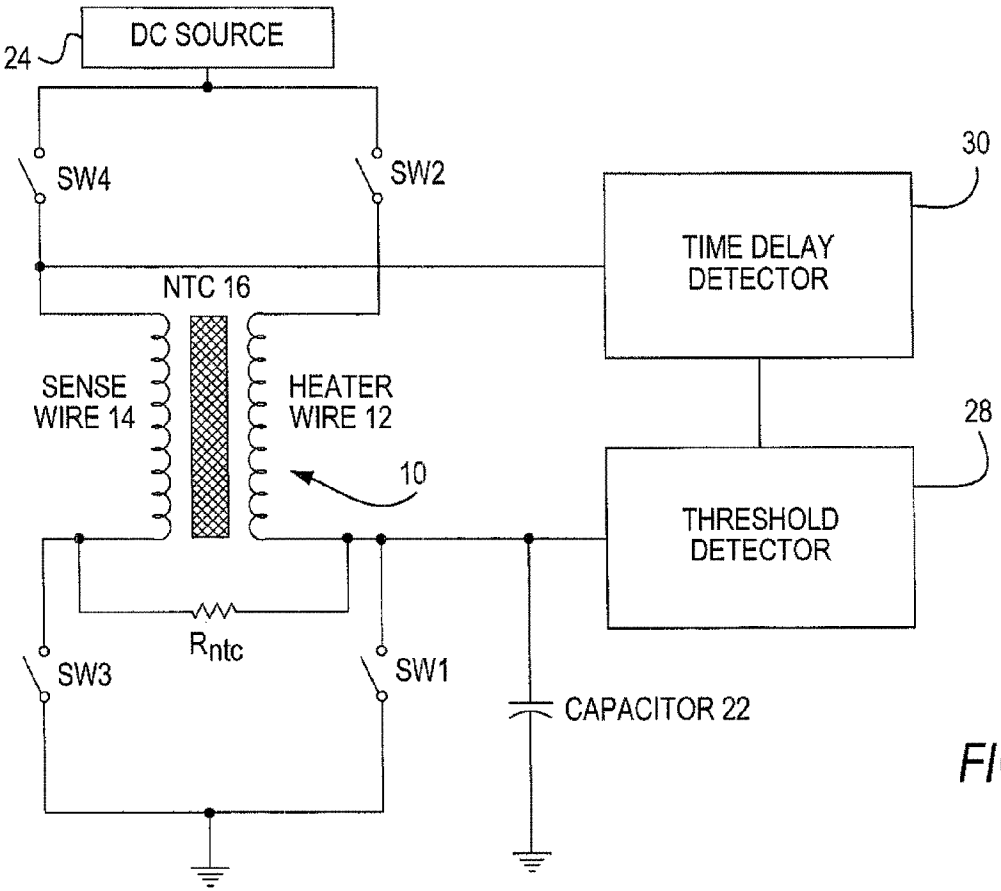
FIG. 2A is a schematic of a first embodiment of a system for controlling a heater wire of a heating element using an equal energy transfer technique.
Figure 2B:
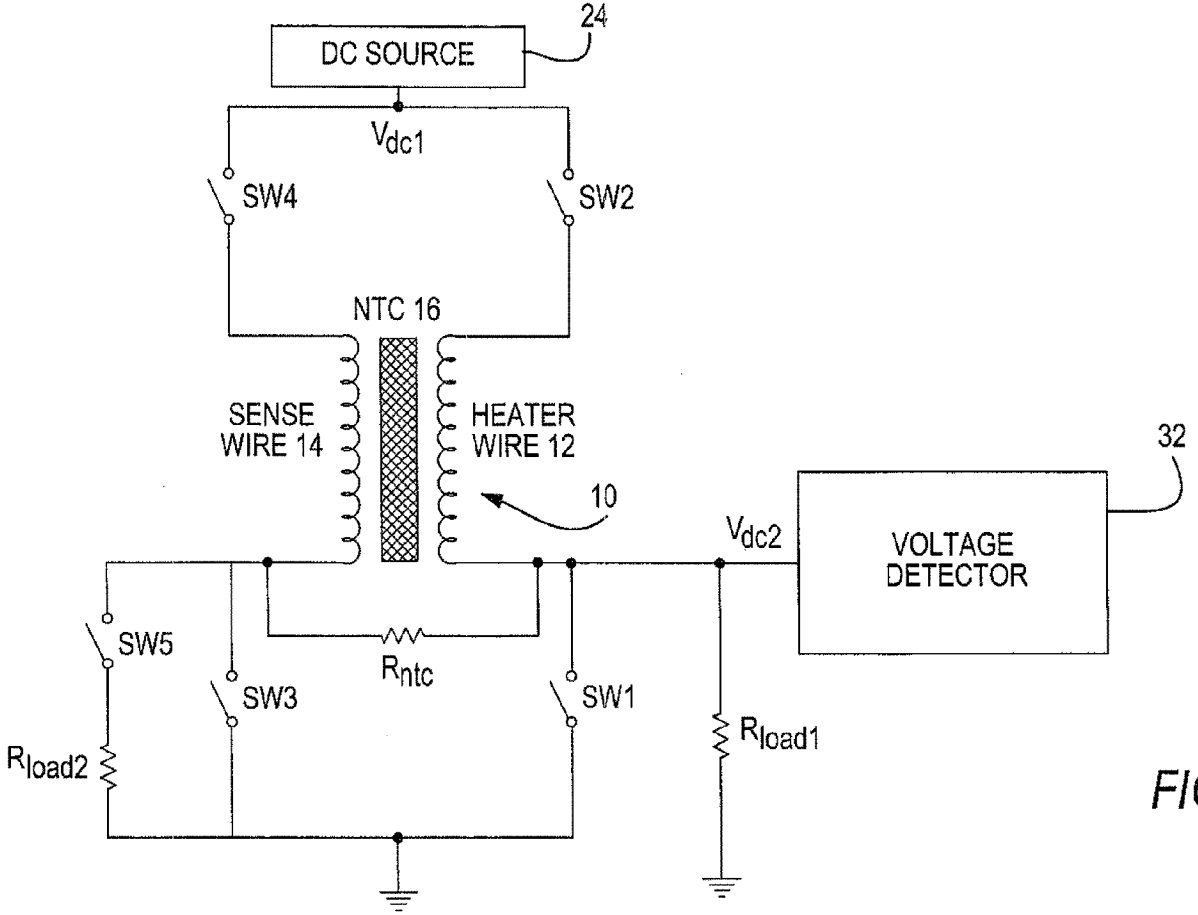
FIG. 2B is a schematic of a second embodiment of a system for controlling a heater wire of a heating element using an equal energy transfer technique.

FIGS. 2A and 2B illustrate circuits wherein the temperature of a heater wire, forming part of a heating element that also includes an NTC layer, is controlled. In these systems and methods for using them, a circuit is constructed and controlled such that if some electric current is passed through the NTC layer at any period of time, an opposite direction compensation current is passed through the same NTC layer in the immediately following period of time, and is therefore referred to as an equal energy transfer method. The magnitude and duration of the compensation current is set to equalize the amount of energy transferred through the NTC layer in both directions.

The circuit shown in FIG. 2A has two operating modes. In a first, heating mode, switches SW1 and SW2 connected to the first and second ends of the heater wire 12, respectively, are closed, and switches SW3 and SW4, connected to the first and second ends of the sensor wire 12, respectively, are open. A DC power current from the DC source 24 (e.g., battery) flows through the heater wire 12 increasing its temperature. The sensor wire 14 is floating and polarization of the NTC layer 16 does not occur. Instead of switches, it is foreseen that other electronic components that enable selective control of the flow of electricity may be used.

Alternatively, in the heating mode, the switches SW3 and SW4 may be also closed. In this case, the sensor wire acts as a supplementary heater wire. Since the first and second ends of both the heater wire 12 and the sensor wire 14 are connected to the same positive and negative supply terminals, a voltage differential is not created in any place along the length of the heater wire 12.

Every few seconds, the heating mode is interrupted, and the circuit is switched into a second, measurement or sensing mode.

The measurement mode consists of at least two periods. During a first period of the measurement mode, switches SW1, SW2 and SW3 are open, and switch SW4 is closed. Current from the DC source 24 flows through the switch SW4 and the NTC layer 16 and charges capacitor 22, connected to the second end of the heater wire 12, long enough to ensure that capacitor 22 is charged to the supply voltage. At some point, the voltage at capacitor 22 reaches a threshold level preset in a threshold detector 28 connected to the second end of the heater wire 12. A time delay between a closure of the switch SW4 and a threshold crossing is generally proportional to the resistance $R_{ntc}$ of the NTC layer 16. With an increase in temperature, the resistance $R_{ntc}$ of the NTC layer 16 and the resulting time delay decrease. A time delay detector 30 compares the time delay with a preset value and if the detected time delay is smaller than the pre-set value, the next heating cycle is skipped. More generally, a time delay between closure of the switch SW4 and capacitor 22 reaching the threshold is determined via the time delay detector 30, and initiation of the heating mode of the heater wire 12 is controlled based on the detected time delay.

The second period of the measurement mode immediately follows the first one. During this period, switches SW1, SW2 and SW4 are open and switch SW3 is closed. Capacitor 22 discharges through the NTC layer 16 and the switch SW3 long enough to ensure that the capacitor 22 is fully discharged. In this manner, the amount of energy transferred through the NTC layer 16 during the first measurement period and during the second measurement period are equalized so that the average amount of energy transferred through the NTC layer 16 in the entire measurement mode equals zero. Polarization of the NTC layer 16 does not occur.

The duration of the measurement mode periods may be reduced by switching to the second period either immediately after the capacitor voltage reaches the threshold or at any time thereafter. Since the energy accumulated in the capacitor 22 during the charge time is the only energy available for the discharge, the amount of energy transferred through the NTC layer 16 in both directions will invariably be equal.

The measurement period cycles may be repeated several times to increase measurement accuracy.

FIG. 2B illustrates an amplitude-based implementation of the equal energy transfer method described with reference to FIG. 2A and includes similar components having the same functions described above. However, the circuit shown in FIG. 2B differs from that shown in FIG. 2A in that it includes a first load resistor $R_{load1}$ electrically coupled between the second end of the heater wire 12 and ground, instead of capacitor 22, an additional switch SW5 and a second load resistor $R_{load2}$ electrically coupled between the second end of the sensor wire 14 and ground, and a voltage detector 32, instead of the threshold detector 28 and time delay detector 30 of the embodiment shown in FIG. 2A.

The circuit shown in FIG. 2B also has two operating modes. In a first, heating mode, switches SW1 and SW2 are closed, and switches SW3, SW4 and SW5 are open. A DC power current from the DC source 24 (e.g., a battery) flows through the heater wire 12 increasing its temperature. The sensor wire 14 is floating and polarization of the NTC layer 16 does not occur.

Alternatively, in this mode the switches SW3 and SW4 may also be closed. In this case, the sensor wire 14 acts as a supplementary heater wire. Since the first and second ends of both the heater wire 12 and the sensor wire 14 are connected to the same positive and negative supply terminals, a voltage differential is not created in any place along the length of the heater wire 12.

Every few seconds, this mode is interrupted, and the circuit is switched into a second, measurement or sensing mode.

The measurement mode consists of at least two periods. During a first period of the measurement mode, switches SW1, SW2, SW3 and SW5 are open, and switch SW4 is closed. Current from the DC source 24 having a voltage of $V_{dc1}$ flows through switch SW4 and the resistance $R_{ntc}$ of the NTC layer 16, and develops a voltage drop $V_{dc2}$ on the load resistor $R_{load1}$. The resistance $R_{ntc}$ of the NTC layer 16 coupled with the load resistor $R_{load1}$ forms a voltage divider. An equation representing the voltage drop is as follows:

$$V_{dc2}=V_{dc1}*R_{load1}/(R_{ntc}+R_{load1})$$

With an increase in temperature, the resistance $R_{ntc}$ of the NTC layer 16 decreases, and the output voltage of the voltage divider increases. The voltage detector 32 compares the output voltage $V_{dc2}$ of the voltage divider with a preset value and if the output voltage of the voltage divider is greater than the pre-set value, the next heating cycle is skipped. More generally, the voltage detector 32 compares an output voltage $V_{dc2}$ of the voltage divider with a preset value, and initiation of the heating mode is controlled based on the comparison of the output voltage $V_{dc2}$ of the voltage divider relative to the preset value.

The second period of the measurement mode immediately follows the first one. During this period, switches SW1, SW3 and SW4 are open and switches SW2 and SW5 are closed. Current from the DC source 24 flows through switch SW2 and the resistance $R_{ntc}$ of the NTC layer 16 and develops a voltage drop across $R_{load2}$.

If $R_{load1}=R_{load2}$, the duration of both periods of the measurement mode are substantially equal. However, if $R_{load1}$ is not equal to $R_{load2}$, then the duration of the second measurement mode period should satisfy the equation:

$$t_{meas2}=(t_{meas1}R_{load2}V_1)/(R_{load1}V_2)$$

Thus, the time during which the switches SW2 and SW5 are closed ($t_{meas2}$) is controlled based on the load resistors $R_{load1}$ and $R_{load2}$, corresponding voltage drops $V_1$ and $V_2$ on the load resistors and the time ($t_{meas1}$) during which the switch SW4 is closed and the remaining switches are open (i.e., the time of the first measurement period). This control may be effected by common electronic components as known to those skilled in the art to which this invention pertains.

In this manner, the amount of energy transferred through the NTC layer 16 during the first period of the measurement mode and the second period of the measurement mode are equalized and the average amount of energy transferred through the NTC layer 16 in the entire measurement mode equals zero. As such, polarization of the NTC layer 16 does not occur.

The two periods of the measurement mode may be repeated several times, e.g., in cycles, to increase measurement accuracy.

It is recognized that other positions of the phase shift capacitor 22 and other positions of the load resistors $R_{load1}$ and $R_{load2}$ are possible, as well as the Rntc test current may be originated from the heater wire 12 side with the corresponding change in the detectors position and switches operation. All these changes do not constitute a departure from the scope and spirit of the present invention.

Figure 3:
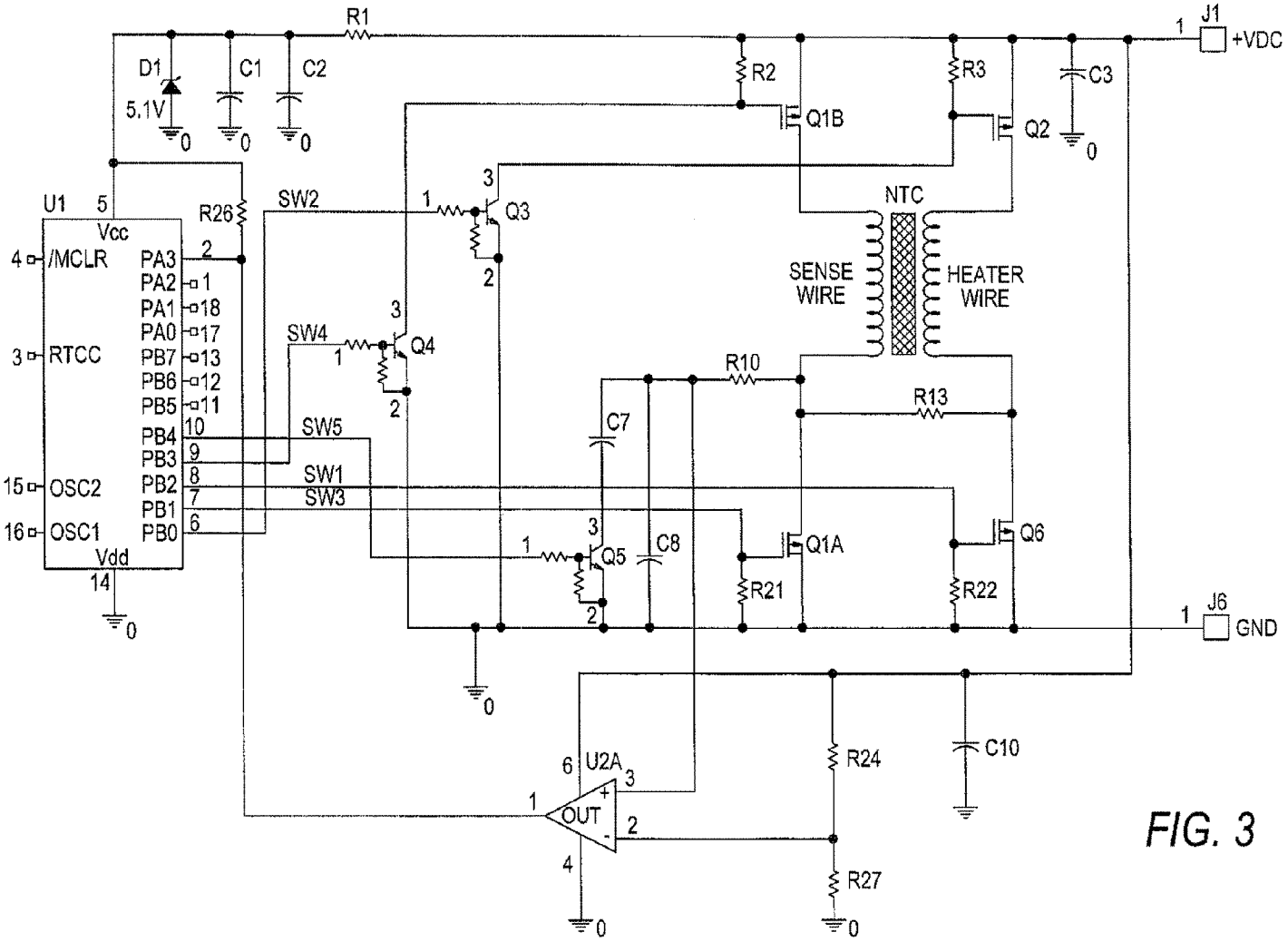
FIG. 3 shows an implementation of the system shown in FIG. 2A.

One of the practical implementations of the equal energy transfer technique described above with reference to FIG. 2A is in a battery-operated heating pad or electric blanket controller and is shown in FIG. 3.

In FIG. 3, a MOSFET Q6 represents switch SW1 shown in FIG. 2A, MOSFET Q2 represents switch SW2, MOSFET Q1A represents switch SW3, and MOSFET Q1B represents switch SW4. Capacitor C8 is equivalent to the capacitor 22 in FIG. 2A, in this case situated at the sensor wire side as was mentioned above. The threshold detector 28 is implemented as a generic voltage comparator U2A, and the threshold is set by a voltage divider R24R27 at exactly one half of the battery voltage. A generic microcontroller U1 controls the entire circuit operation and performs the time delay detector function, i.e., incorporates the time delay detector 30 shown in FIG. 2A.

Composite transistors Q3 and Q4 and resistors R2 and R3 perform a level shift function to control P-channel MOSFETs Q1B and Q2, corresponding to switches SW4 and SW2, respectively. Zener diode D1 along with resistor R1 and capacitors C1 and C2 comprise a microcontroller power supply, and the limit voltage is set at about 5V.

Another optional composite transistor Q5 connects an optional capacitor C7 in parallel to capacitor C8 to enhance time measurement resolution when measuring small resistances, as explained below.

The circuit shown in FIG. 3 is designed to be generally insensitive to the battery voltage and possible variations of the timing capacitor. It also provides the sensor wire resistance measurement, which is indicative of the integral temperature of the heating element 10.

Figure 4:
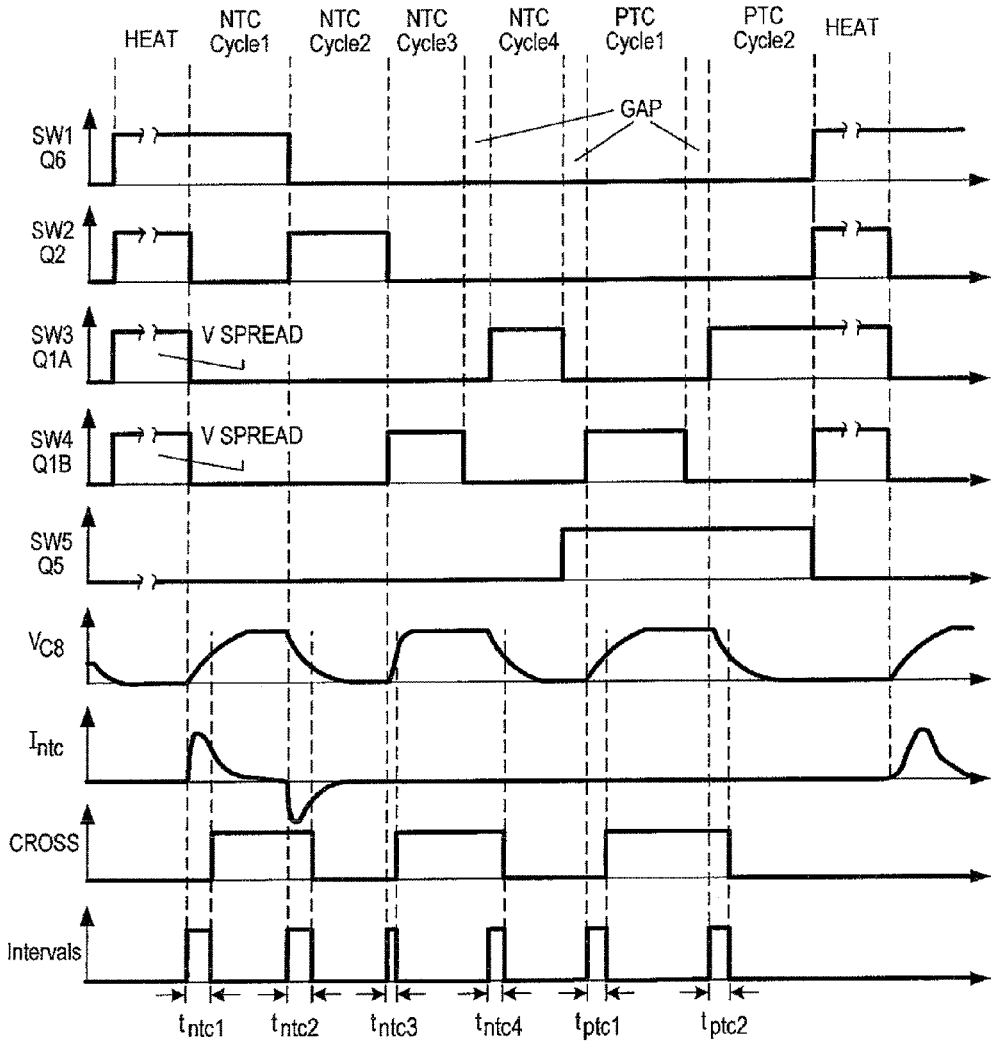
FIG. 4 is a signal diagram of the circuit shown in FIG. 3.

The principle of operation of the circuit shown in FIG. 3 is illustrated in FIG. 4. The Gap time intervals are added to compensate for physical delays associated with the MOSFETs switching On and Off.

The circuit operates as follows:

1. Heating Cycle. All four MOSFET switches (Q1A, Q1B, Q2 and Q6) are ON. The heater wire and the sensor wire provide heat. Capacitor C8 is held at 0V by conducting Q1A.

2. NTC Layer Resistance Measurement:

a. Cycle 1. Switch Q2 is On, all other switches are Off. Capacitor C8 charges through the NTC layer in parallel with resistor R13, and resistor R10. When the voltage at capacitor C8 reaches the threshold voltage, comparator U2A changes its output voltage from low to high. The time interval is stored by MCU U1 as $t_{ntc1}$. Capacitor C8 is allowed to charge to the full battery voltage.

b. Cycle 2. Switch Q6 is On, all other switches are Off. Capacitor C8 discharges through resistor R10 and the NTC layer in parallel with resistor R13. When the voltage at capacitor C8 reaches the threshold voltage, comparator U2A changes its output voltage from high to low. The time interval is stored by MCU U1 as $t_{ntc2}$. Capacitor C8 is allowed to fully discharge.

c. Cycle 3. Switch Q1B is On, all other switches are Off. Capacitor C8 charges through the sensor wire and resistor R10. When the voltage at capacitor C8 reaches the threshold voltage, comparator U2A changes its output voltage from low to high. The time interval is stored by MCU U1 as $t_{ntc3}$. Capacitor C8 is allowed to charge to the full battery voltage.

d. Cycle 4. Switch Q1A is On, all other switches are Off. Capacitor C8 discharges through resistor R10. When the voltage at capacitor C8 reaches the threshold voltage, comparator U2A changes its output voltage from high to low. The time interval is stored by MCU U1 as $t_{ntc4}$. Capacitor C8 is allowed to fully discharge.

3. PTC (Positive Temperature Coefficient) Sensor Wire Resistance Measurement:

a. Cycle 1. Switches Q1B and Q5 are On, all other switches are Off. Capacitors C8 and C7 charge through the sensor wire and resistor R10. When the voltage at capacitor C8 reaches the threshold voltage, comparator U2A changes its output voltage from low to high. The time interval is stored by MCU U1 as $t_{ptc1}$. Capacitors C8 and C7 are allowed to charge to the full battery voltage.

b. Cycle 2. Switches Q1A and Q5 are On, all other switches are Off. Capacitors C8 and C7 discharge through resistor R10. When the voltage at capacitor C8 reaches the threshold voltage, comparator U2A changes its output voltage from high to low. The time interval is stored by MCU U1 as $t_{ptc2}$. Capacitors C8 and C7 are allowed to fully discharge.

The optional capacitor C7 was added in parallel to capacitor C8 to increase the resistance measurement resolution, since the temperature coefficient of the sensor wire resistance is rather small.

4. Computation:

a. NTC layer resistance is calculated as $$R_{NTC}=R10*[(t_{ntc1}+t_{ntc2})/2t_{ntc4}-1].$$

Since voltage or capacitance values are not in the equation, and R10 is a known fixed resistor, $R_{NTC}$ is measured in a voltage and capacitor value variation-independent manner.

b. PTC Sensor wire resistance is calculated as $$R_{PTC}=R10*(t_{ptc1}/t_{ptc2}-1).$$

Since voltage or capacitance values are not in the equation, and R10 is a known fixed resistor, $R_{PTC}$ is measured in a voltage and capacitor variation-independent manner.

5. Decision making. The heater wire design provides that $R_{NTC}$ and $R_{PTC}$ values are representative of the immediate heater wire temperature. The corresponding preset values of these resistances are selected to keep the heater wire at the preset temperature. If $R_{NTC}$ is smaller than (or equal to) a preset value, the next heating cycle is replaced by a time interval, when all switches are Off. Similarly, if $R_{PTC}$ is greater than (or equal to) a preset value, the next heating cycle is replaced by a time interval, when all switches are Off. In this manner, the temperature of the heater wire is reliably controlled.

The $I_{NTC}$ graph in FIG. 4 depicts the current passing through the NTC layer of the heating element. As can be seen, the NTC layer is exposed only to symmetrical bipolar pulses, which eliminate any harmful polarization or aging effects normally associated with a DC application of this type of NTC dielectric.

To increase resolution of resistance measurement and to enhance noise immunity, any pair of the charge/discharge cycles may be repeated several times and the appropriate time values added up.

In the circuit shown in FIG. 3, it is required that the threshold voltage of the voltage comparator is set at exactly one half of the battery voltage for the proposed equations to hold valid.

Figure 5:
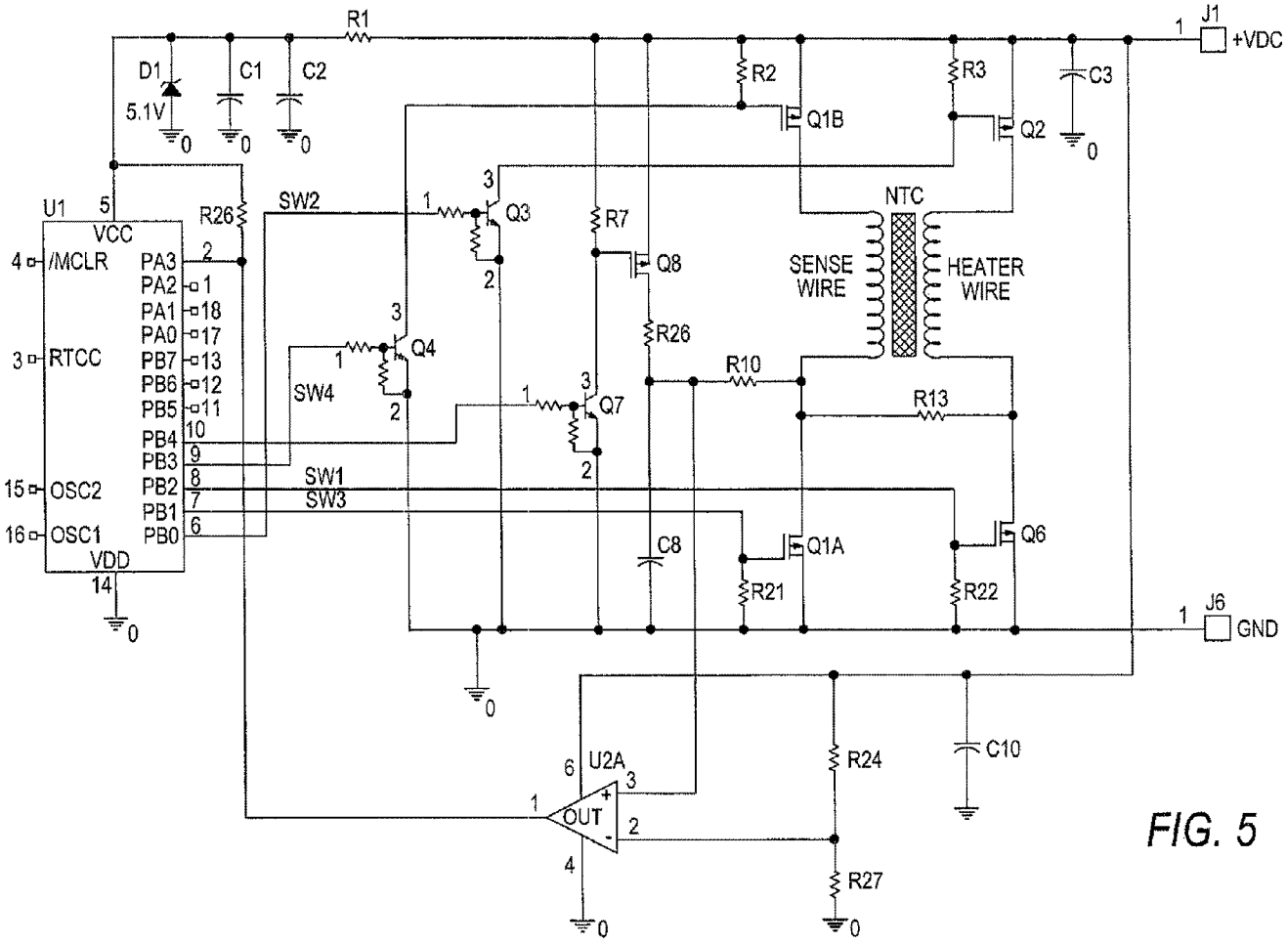
FIG. 5 shows an enhanced implementation of a variation of the system shown in FIG. 2A.

The circuit shown in FIG. 5 offers a more universal solution. Specifically, by adding another low cost switch Q8 with a corresponding level shifter Q7 and a resistor R28, the circuit shown in FIG. 5 offers more relaxed tolerance requirements of the components, and permits the use of an inexpensive operational amplifier (opamp) for voltage comparator U2A. The threshold voltage can be set at any practical level, e.g., taken from the MCU power supply. Resistor R10 in this case, is used to limit discharge current through switch Q1A, and may be omitted.

The circuit shown in FIG. 5 operates as follows:

1. Heating Cycle. Switches Q1A, Q1B, Q2 and Q6 switches are ON. Heater wire and the sensor wire provide heat. Capacitor C8 is held at 0V by conducting Q1A.

2. NTC layer resistance measurement:

a. Cycle 1. Switch Q2 is On, all other switches are Off. Capacitor C8 charges through the NTC layer in parallel with resistor R13, and resistor R10. When the voltage at capacitor C8 reaches the threshold voltage, comparator U2A changes its output voltage from low to high. The time interval is stored by MCU U1 as $t_{ntc1}$. Capacitor C8 is allowed to charge to the full battery voltage. (Alternatively, the charge may be stopped and the next cycle may be initiated at any time after the threshold is reached.)

b. Cycle 2. Switch Q6 is On, all other switches are Off. Capacitor C8 discharges through R10 and the NTC layer in parallel with resistor R13. When the voltage at capacitor C8 reaches the threshold voltage, comparator U2A changes its output voltage from high to low. Capacitor C8 is allowed to fully discharge.

3. PTC (Positive Temperature Coefficient) Sensor wire resistance measurement:

a. Cycle 1. Switch Q1B is On, all other switches are Off. Capacitor C8 charges through the sensor wire and resistor R10. When the voltage at capacitor C8 reaches the threshold voltage, comparator U2A changes its output voltage from low to high. The time interval is stored by MCU U1 as $t_{ptc1}$. Capacitor C8 is allowed to charge to the full battery voltage. Alternatively, the charge may be stopped and the next cycle may be initiated at any time after the threshold is reached.

b. Cycle 2. Switch Q1A is On, all other switches are Off. Capacitor C8 discharges through resistor R10. When the voltage at capacitor C8 reaches the threshold voltage, comparator U2A changes its output voltage from high to low. Capacitor C8 is allowed to fully discharge.

4. Reference Resistance Measurement:

a. Cycle 1. Switch Q8 is On, all other switches are Off. Capacitor C8 charges through resistor R28. When the voltage at capacitor C8 reaches the threshold voltage, comparator U2A changes its output voltage from low to high. The time interval is stored by MCU U1 as $t_{ref}$. (The charge may be stopped and the next cycle may be initiated at any time after the threshold is reached.)

b. Cycle 2. Switch Q1A is On, all other switches are Off. Capacitor C8 discharges through resistor R10. When the voltage at capacitor C8 reaches the threshold voltage, comparator U2A changes its output voltage from high to low. Capacitor C8 is allowed to fully discharge.

5. Computation:

a. NTC layer resistance is calculated as $$R_{NTC}=R28*t_{ntc1}/t_{ref}-R10,$$

or if R10=0, $$R_{NTC}=R28*t_{ntc1}/t_{ref}$$

Since voltage or capacitance values are not in the equation, and R28 and R10 are known fixed value resistors, $R_{NTC}$ is measured in a voltage and capacitor value variation-independent manner.

b. PTC Sensor wire resistance is calculated as $$R_{PTC}=R28*t_{ptc1}/t_{ref}-R10,$$

or if R10=0, $$R_{PTC}=R28*t_{ptc1}/t_{ref}$$

Since voltage or capacitance values are not in the equation, and R28 and R10 are known fixed resistors, $R_{PTC}$ is measured in a voltage and capacitor value variation-independent manner.

6. Decision making. The heater wire design provides that $R_{NTC}$ and $R_{PTC}$ values are representative of the immediate temperature of the heater wire. The corresponding preset values of these resistances are selected to keep the heater wire at the preset temperature. If $R_{NTC}$ is smaller than (or equal to) a preset value, the next heating cycle is replaced by a time interval, when all switches are Off. Similarly, if $R_{PTC}$ is greater than (or equal to) a preset value, the next heating cycle is replaced by a time interval, when all switches are Off. In this manner, the temperature of the heater wire is reliably controlled.

Figure 6:
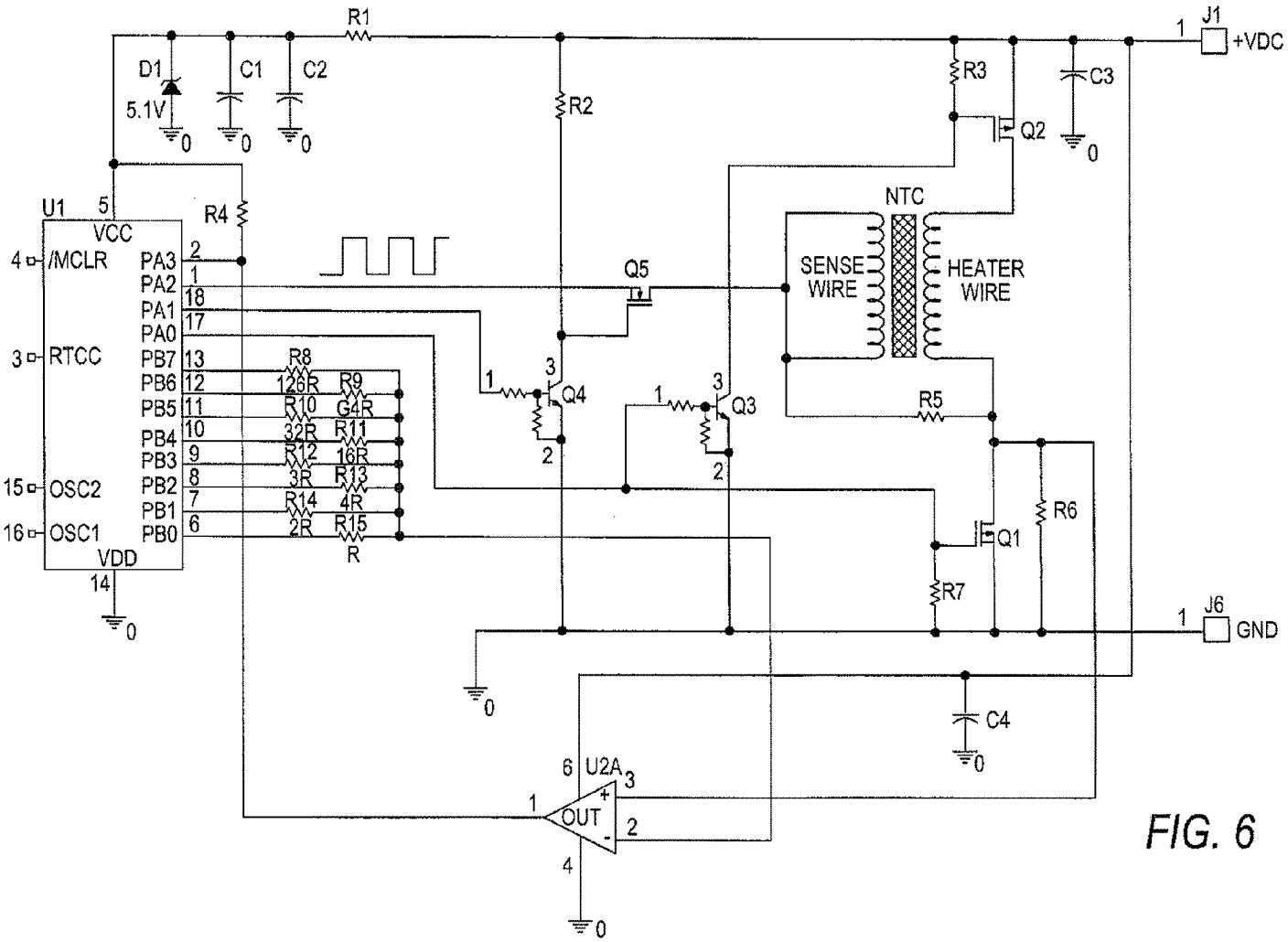
FIG. 6 shows an implementation of the system shown in FIG. 1B.

One of the possible implementations of the AC excitation method of FIG. 1B is shown in FIG. 6. This implementation uses an amplitude-based measurement configuration. In FIG. 6, the switch SW1 is implemented as a MOSFET Q1, the switch SW2 is implemented as MOSFET Q2, and the switch SW3 is implemented as MOSFET Q5. MOSFETs Q3 and Q4 perform a level shifting function. A generic microcontroller U1 functions as the AC generator 18 by providing a 50% duty cycle square wave on one of its pins. Together with the voltage comparator U2, the microcontroller U1 and resistors R8-R15 provide a voltage detection (measurement) function, i.e., comprise the voltage detector 26. The microcontroller U1 and the resistors R8-R15 form a digital to analog converter. Resistor R1, diode D1 and capacitors C1 and C2 form a microcontroller power supply.

The circuit operates as follows:

1. Heating Cycle. Switches Q1 and Q2 are ON, switch Q5 is Off. The heater wire provides heat. Switch Q5 blocks any current through the NTC layer. Every few seconds, the heating cycle is interrupted by the NTC layer resistance measurement procedure.

2. NTC layer resistance measurement: Switches Q1 and Q2 are Off, Switch Q5 is On. Microcontroller U1 provides a 50% duty cycle square wave on Pint (PA2). This square wave passes through the switch Q5 to a voltage divider formed by the resistance of the NTC layer in parallel with resistor R5, and a load resistor R6. During the high portion of the square wave, the microcontroller U1 creates a linear voltage ramp rising from 0V to the Vcc voltage of the microcontroller by incrementing a binary 8 bit word at the PB0-PB7 ports. This voltage ramp is compared by the voltage comparator U2A with voltage on the load resistor R6. When the ramp voltage exceeds the voltage on R6, the value of the binary word at PB0-PB7 is stored by the microcontroller as Nntc.

3. Computation: NTC layer resistance is calculated as $$R_{ntc}=(256/Nntc-1)*R6$$

Since the AC excitation voltage and the reference voltage of the digital to analog converter are derived from the same source, the microcontroller's Vcc voltage, these values do not affect the calculation results. The entire computation stage may be omitted for the fixed value of the load resistor R6. In this case, the Nntc value should be used for decision making.

4. Decision making. The heating element design provides that $R_{NTC}$ is representative of the immediate heater wire temperature. The corresponding preset values of these resistances are selected to keep the heater wire at the preset temperature. If $R_{NTC}$ is smaller than (or equal to) a preset value, the next heating cycle is replaced by a time interval, when all switches are Off.

Alternatively, if the calculation step has been omitted, the Nntc value can be used as the heater device temperature measure. This value should be compared to a preset number or value. If $N_{NTC}$ is greater than (or equal to) the preset number, the next heating cycle is replaced by a time interval, when all switches are Off. In this manner, the temperature of the heater device is reliably controlled.

The above described implementations demonstrate basic On/Off control algorithms, and are not intended to limit the application of the circuits in accordance with the invention. By changing the duration of the heating cycle period and/or the Off period, any type of more sophisticated control algorithms may be implemented.

Having described exemplary embodiments of the invention with reference to the accompanying drawings, it will be appreciated that the present invention is not limited to those embodiments, and that various changes and modifications can be effected therein by one of ordinary skill in the art without departing from the scope or spirit of the invention as defined by the appended claims.

The invention claimed is:

1. A method for controlling the temperature of flexible heating wire powered by a direct current (DC) power source, the heating wire comprising at least two conductors in electrical contact with a Negative Temperature Coefficient polymer layer (NTC layer) disposed between said at least two conductors; the method comprising:

supplying power from said DC power source to at least one of said at least two conductors for a fixed period of time, called a heating period, to increase a temperature of said flexible heating wire, while connecting the other of the at least two conductors to prevent current flow through the NTC layer, measuring a resistance of the NTC layer by passing a current flow through the NTC layer in both positive and negative directions and providing equal energy transfer in both the positive and negative directions to prevent polarization of the NTC layer, comparing the resistance value of the NTC layer with a predetermined value, and initiating a next heating period with DC power if the resistance of the NTC layer is above the predetermined value, and initiating the next heating period without DC power if the resistance of the NTC layer is not greater than the predetermined value.

2. The method of claim 1, wherein the measurement of the resistance of the NTC layer comprises:

disposing a reactance in series with one of the at least two conductors, disposing a switching circuit to charge and discharge said series reactance through the NTC layer, disposing a threshold detector which is actuated by the voltage level at a junction of the reactance and resistance of said NTC layer, and disposing a time delay detector whose time delay is determined between the time of the closure of said switching circuit and a time to reach the voltage threshold, wherein said time delay is proportional to the resistance of said NTC layer.

3. The method of claim 1, wherein the said measurement of the resistance of the NTC layer comprises:

disposing a first load resistor in series with one of the at least two conductors powered by said DC power source, disposing a second load resistor in series with an other conductor of said at least two conductors, disposing a switching circuit to switch in said heating mode the at least two conductors to a DC power source to increase the temperature of said heating wire and to periodically switch each of the at least two conductors in equal proportions to said first and second load resistors through the NTC layer, disposing a voltage detector for detecting the voltage across both said first and second load resistors, and disposing a control to operate said switching circuit and for determining the temperature of said heating element as a function of the voltage detected across at least one of the first and second load resistors.

4. The method of claim 1, wherein the said measurement of the resistance of the NTC layer comprises:

disposing a low power AC source (oscillator) in series with one of the at least two conductors, disposing a resistor in series with the other conductor of the at least two conductors, disposing a switching circuit to arrange that AC current from said low power AC source flows through the NTC layer into said resistor, disposing a threshold detector which is actuated by the AC voltage level at a junction of the resistor and resistance of said NTC layer, wherein said AC voltage level is inversely proportional to the resistance of said NTC layer.

5. The method of claim 1, wherein the said measurement of the resistance of the NTC layer comprises:

disposing a low power AC source (oscillator) in series with one of the at east two conductors, disposing a reactance in series with the other conductor of the at least two conductors, disposing a switching circuit to arrange that AC current from said low power AC source flows through the NTC layer into said reactance, disposing a phase detector which is actuated by the AC voltage phase shift at a junction of the reactance and resistance of said NTC polymer layer, wherein said AC voltage phase shift is proportional to the resistance of said NTC polymer layer.

* * * * *